US012398494B2

(12) United States Patent
Zhong et al.

(10) Patent No.: US 12,398,494 B2
(45) Date of Patent: Aug. 26, 2025

(54) FIRE RESISTANT SPUN YARN, FABRIC, GARMENT AND FIRE RESISTANT WORKWEAR

(71) Applicant: JIANGSU BAIHOO TEXTILES TECHNOLOGY CO., LTD, Jiangsu (CN)

(72) Inventors: Yichen Zhong, Jiangsu (CN); Chongyan Zhong, Jiangsu (CN)

(73) Assignee: Jiangsu Baihoo Textiles Technology Co., Ltd, Jiangsu (CN)

( * ) Notice: Subject to any disclaimer, the term of this patent is extended or adjusted under 35 U.S.C. 154(b) by 931 days.

(21) Appl. No.: 17/600,421

(22) PCT Filed: May 11, 2021

(86) PCT No.: PCT/CN2021/092956
§ 371 (c)(1),
(2) Date: Sep. 30, 2021

(87) PCT Pub. No.: WO2021/228062
PCT Pub. Date: Nov. 18, 2021

(65) Prior Publication Data

US 2022/0325442 A1 Oct. 13, 2022

(30) Foreign Application Priority Data

May 12, 2020 (CN) ..... 202010396022.X

(51) Int. Cl.
*D02G 3/44* (2006.01)
*D02G 3/04* (2006.01)

(52) U.S. Cl.
CPC ..... *D02G 3/443* (2013.01); *D02G 3/04* (2013.01); *D02G 3/441* (2013.01); *D10B 2101/12* (2013.01); *D10B 2101/20* (2013.01); *D10B 2201/01* (2013.01); *D10B 2201/20* (2013.01); *D10B 2321/08* (2013.01); *D10B 2331/301* (2013.01); *D10B 2401/16* (2013.01); *D10B 2501/04* (2013.01)

(58) Field of Classification Search
None
See application file for complete search history.

(56) References Cited

U.S. PATENT DOCUMENTS

| | | | |
|---|---|---|---|
| 2005/0208284 A1 | 9/2005 | Schwung et al. | |
| 2006/0160454 A1* | 7/2006 | Handermann | B32B 5/08 442/403 |
| 2013/0157052 A1 | 6/2013 | Tsotsis et al. | |
| 2014/0283290 A1 | 9/2014 | Mizobuchi et al. | |
| 2020/0224341 A1 | 7/2020 | Harada et al. | |

FOREIGN PATENT DOCUMENTS

| | | | |
|---|---|---|---|
| CN | 1205020 | A | 1/1999 |
| CN | 1646310 | A | 7/2005 |
| CN | 101748549 | A | 6/2010 |
| CN | 103827367 | A | 5/2014 |
| CN | 104630958 | A | 5/2015 |
| CN | 104846468 | A | 8/2015 |
| CN | 105113209 | A | * 12/2015 |
| CN | 106283333 | A | 1/2017 |
| CN | 108330680 | A | 7/2018 |
| CN | 109642361 | A | 4/2019 |
| CN | 111286836 | A | 6/2020 |
| CN | 111979627 | A | 11/2020 |
| EP | 3524721 | A1 | 8/2019 |
| JP | 2016011736 | A | 1/2016 |

OTHER PUBLICATIONS

CN 105113209 English Translation (Year: 2015).*
CN 111349240 A Machine English Translation Jun. 30, 2020 (Year: 2020).*
Xing, Jian, et al., "Enhanced Oxidation Resistance of Polyphenylene Sulfide Composits Based on Montmorillonite Modified by Benzimidazolium Salt," Polymers, vol. 10, No. 1, p. 83, Jan. 17, 2018.
Extended European Search Report issued Mar. 15, 2023 in corresponding EP Application No. 21783378.9.
International Search Report/Written Opinion issued Jul. 29, 2021 in Application No. PCT/CN2019/113622.
First Office Action of CN priority (202010396022.X).
Second Office Action of CN priority (202010396022.X).

* cited by examiner

*Primary Examiner* — Jenna L Johnson
(74) *Attorney, Agent, or Firm* — IceMiller LLP

(57) ABSTRACT

Provided is a fire resistant yarn, the yarn comprises, based on the total weight of yarn, 4-20% by weight of modified polyphenylene sulfide fiber, and 35-90% by weight of modified acrylic fiber, wherein the modified polyphenylene sulfide is a polyphenylene sulfide which is at least partially sulphonylated, sulfoxidated, or a combination thereof. Provided further is a fire resistant fabric, the fabric comprises, based on the total weight of the fabric, 4-20% by weight of modified polyphenylene sulfide fiber, and 35-90% by weight of modified acrylic fiber, wherein the modified polyphenylene sulfide is a polyphenylene sulfide which is at least partially sulphonylated, sulfoxidated, or a combination thereof. Provided further is a garment and a fire resistant workwear comprising the fire resistant fabric according to the present disclosure.

24 Claims, No Drawings

FIRE RESISTANT SPUN YARN, FABRIC, GARMENT AND FIRE RESISTANT WORKWEAR

CROSS-REFERENCE TO RELATED APPLICATION

This application is a Section 371 of International Application No. PCT/CN2021/092956 filed May 11, 2021, which claims priority to Chinese Patent Application No. 202010396022.X filed May 12, 2020, the disclosures of which are incorporated herein by reference in their entireties.

TECHNICAL FIELD

The present application relates to the field of fire resistant personal protective fabric, and specifically relates to a fire resistant spun yarn, fabric, garment and fire resistant workwear.

BACKGROUND

Fire resistant or garment is widely used in fire protection or labor protection. The high temperature and high heat resistant fiber commonly used in the market is aramid, polysulfonamide (PSA), polybenzimidazole fiber (PBI), polyimide fiber (PI), polyoxadiazole (POD), poly(p-phenylene-benzobisoxazole) (PBO), polyarylate fiber (PAR), melamine fiber, glass fiber or basalt fiber.

A fiber used as fire resistant fabric or garment should generally have good fire resistance, which is spinnable, and is dyeable. The current yarn is usually difficult to be dyed in the state of fiber/yarn/fabric. After dyeing, the different-colored fiber material is exposed on the surface of yarn, resulting in a poor appearance. Alternatively the need to be dyed by the original solution is associated with high cost.

CN103827367A relates to a flameproof spun yarn having flameproofness, wherein the flameproof spun yarn comprises a modacrylic fiber containing an antimony compound and a polyarylate-based fiber, and the flameproof spun yarn contains 1 to 30 wt % of the polyarylate-based fiber relative to the total weight of the flameproof spun yarn.

SUMMARY

In an aspect, provided is a fire resistant yarn, the yarn comprises, based on the total weight of yarn, 4-20% by weight of modified polyphenylene sulfide fiber, and 35-90% by weight of modified acrylonitrile fiber, wherein the modified polyphenylene sulfide is a polyphenylene sulfide which is at least partially sulphonylated, at least partially sulfoxidated, or a combination thereof.

In an embodiment, the yarn further comprises, based on the total weight of the yarn, 10-55% by weight of cellulosic fiber, wherein the cellulosic fiber is man-made cellulosic fiber, natural cellulosic fiber or a combination thereof.

In a preferable embodiment, based on the total weight of the yarn, the content of the modified polyphenylene sulfide fiber is 5-15% by weight, and/or the content of the modified acrylic fiber is 40-70% by weight, and/or the content of the cellulosic fiber is 15-50% by weight.

In an embodiment, the modified polyphenylene sulfide is the modified polyphenylene sulfide of Formula I, $$\text{(Formula I)} \quad \left[\text{Ar-SO}_x\right]_n,$$

wherein, x=0, 1 or 2, and Ar—$SO_x$ is one or more selected from the group consisting of

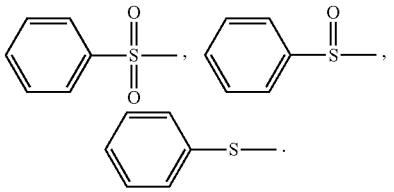

In another embodiment, on the molecular chain of the modified polyphenylene sulfide, the ratio of the number of structural unit of

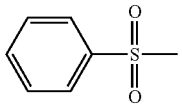

is 30% or more, preferably 40% or more, and/or the ratio of the number of structural unit of

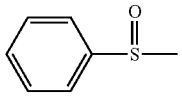

is 25% or more, preferably 30% or more, and/or the ratio of the number of structural unit of

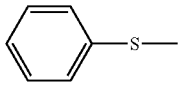

is 20% or less, preferably 10% or less.

In yet another embodiment, the content of oxygen atom on the molecular chain of the modified polyphenylene sulfide is 10-30% by weight, preferably 12-27% by weight, and/or the content of sulfur atom on the molecular chain of the modified polyphenylene sulfide is 10-30% by weight, preferably 15-25% by weight.

In another embodiment, the modified acrylic fiber comprises antimony-containing compound, wherein the antimony-containing compound is selected from the group consisting of antimony trioxide, antimony tetraoxide, antimony pentaoxide and a combination thereof.

In yet another embodiment, based on the total weight of the yarn, the yarn further comprises 10% by weight or less of other fiber selected from the group consisting of aramid, polyarylate, polysulfonamide, polyimide, polyvinyl alcohol fiber, antistatic fiber, polyamide and a combination thereof.

In yet another embodiment, based on the total weight of the yarn, the content of the antistatic fiber is 1.5% by weight or less, and/or the antistatic fiber is carbon fiber or metal fiber.

In another aspect, provided is a fire resistant fabric, the fabric comprises, based on the total weight of the fabric, 4-20% by weight of modified polyphenylene sulfide fiber, and 35-90% by weight of modified acrylic fiber, wherein the modified polyphenylene sulfide is a polyphenylene sulfide which is at least partially sulphonylated, at least partially sulfoxidated, or a combination thereof.

In an embodiment, the fabric comprises, based on the total weight of the fabric, 10-55% of cellulosic fiber, wherein the cellulosic fiber is man-made cellulosic fiber, natural cellulosic fiber or a combination thereof.

In another embodiment, based on the total weight of the fabric, the content of the modified polyphenylene sulfide fiber is 5-15% by weight, and/or the content of the modified acrylic fiber is 40-70% by weight, and/or the content of the cellulosic fiber is 15-50% by weight.

In an embodiment, based on the total weight of the fabric, the fabric further comprises 10% by weight or less of other fiber selected from the group consisting of aramid, polyarylate, polysulfonamide, polyimide, polyvinyl alcohol fiber, antistatic fiber, polyimide and a combination thereof.

In another embodiment, based on the total weight of the fabric, the content of the antistatic fiber is 1.5% by weight or less, and/or the antistatic fiber is carbon fiber or metal fiber.

In another aspect, provided is a fire resistant fabric, comprising the fire resistant yarn according to the present disclosure.

In an embodiment, the carbonized length of the fabric according to the present disclosure measured by the fire resistance test of ASTM D6413 is 4 inches or less.

In another aspect, provided is a garment, comprising the fire resistant fabric according to the present disclosure.

In another aspect, provided is a fire resistant workwear, comprising the fire resistant fabric according to the present disclosure.

DETAILED DESCRIPTION

General Definition

Unless otherwise indicated, all publications, patent applications, patents, and other references mentioned herein are incorporated herein by reference in their entirety.

Unless otherwise defined, all technical and scientific terms used herein have the same meaning as commonly understood by one having ordinary skill in the art to which this disclosure belongs. In case of conflict, definitions in present specification are followed.

Except where expressly noted, trademarks are shown in superscript.

Unless otherwise stated, all percentages, parts, ratios, etc., are by weight.

When an amount, concentration, or other value or parameter is given as either a range, a preferred range or a preferred upper limit value and a preferred lower limit value, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention is limited to the specific values recited when a range is defined.

When the term "about" is used in describing a value or an end-point of a range, the disclosure should be understood to include the specific value or end-point referred to.

The expressions "comprising", or similar expressions having the same meaning "including", "having", and the like, are meant to be open, and do not exclude additional unenumerated elements, steps, or components. The expression "consisting of" excludes any element, step or ingredient that is not specified. The expression "consisting essentially of" means that the scope is limited to the specified elements, steps or components, and the optionally existed elements, steps or components that do not substantially affect the basic and novel characteristics of the claimed subject matter. It should be understood that the expression "comprising" encompasses the expression "consisting essentially of" and "consisting of."

Unless otherwise stated, the term "a combination thereof" refers to a mixture of multiple components by the elements, for example that of 2, 3, 4 and up to the maximum possible value.

Also, the indefinite articles "a" and "an" preceding an element or component according to the present disclosure are intended to be nonrestrictive regarding the number of instances (i.e. occurrences) of the element or component. Therefore "a" or "an" should be read to include one or at least one, and the singular word form of the element or component also includes the plural unless the number is obviously meant to be singular.

"Optional" or "optionally" as used herein means that the subsequently described event or circumstance may or may not occur, and that the description includes instances where the event or circumstance occurs and instances where it does not.

The term "one or more" as used herein means one, two, three, four, five, six, seven, eight, nine or more.

The term "two or more" as used herein means two, three, four, five, six, seven, eight, nine or more.

The term "sulphonylated" as used herein refers to the group with a structure of

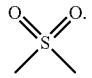

The term "sulfoxidated" as used herein refers to the group with a structure of

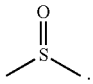

The term "yarn" as used herein refers to a collection of spinning or a collection of a continuous strand of fibers formed by twisting together, which may be used for weaving, plating etc., or prepared into a textile material, a fabric or a textile.

As used herein, the term "structural unit" refers to a combination of atoms that constitute the polymer chain and determine the structure of the polymer to be connected in a certain way. It is the basic unit that monomer molecules were incorporated into the macromolecular chain through polymerization. It is represented herein by n.

Yarn

In an aspect, provided is a fire resistant yarn, wherein the yarn comprises, based on the total weight of yarn, about 4-20% by weight of modified polyphenylene sulfide fiber, and about 35-90% by weight of modified acrylic fiber.

It should be understood that the contents of the components can be reasonably selected such that the total amount of the components is 100%.

Modified Polyphenylene Sulfide Fiber

In the present disclosure, the modified polyphenylene sulfide used in the modified polyphenylene sulfide fiber is oxidized polyphenylene sulfide. Specifically, the modified polyphenylene sulfide is a polyphenylene sulfide which is at least partially sulphonylated, at least partially sulfoxidated, or a combination thereof. Sulphonylated, sulfoxidated means the sulfur atom in the structural unit on the molecular chain of polyphenylene sulfide is oxidized, resulting sulphonyl or sulfinyl.

In a specific embodiment, the modified polyphenylene sulfide is modified polyphenylene sulfide of Formula I, $$\text{(Formula I)} \quad \left[\text{Ar-SO}_x\right]_n$$

wherein, x=0, 1 or 2, and Ar—$SO_x$ is one or more selected from the group consisting of

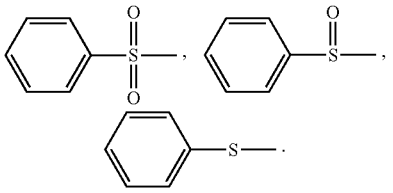

In an embodiment, the modified polyphenylene sulfide has a weight average molecular weight of about 1000-10000000, preferably about 10000-1000000. In another embodiment, the number of structural unit in Formula I (i.e., n) is e.g., about 10-70000.

In an embodiment, a structural unit containing sulphonyl is present on the molecular chain of the modified polyphenylene sulfide. In another embodiment, a structural unit containing sulfinyl is present on the molecular chain of the modified polyphenylene sulfide. In yet another embodiment, a structural unit containing sulphonyl and a structural unit containing sulfinyl are present on the molecular chain of the modified polyphenylene sulfide at the same time.

In a preferable embodiment, on the molecular chain of the modified polyphenylene sulfide, the ratio of the number of structural unit of

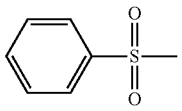

is about 30% or more, preferably about 40% or more, for example, about 45%, 50%, 60%, 80%, 100%, such as about 40-80%, 45-50%. The ratio of the number of structural unit of

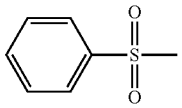

on the molecular chain of the modified polyphenylene sulfide refers to the ratio of amount of the structural unit of

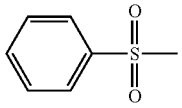

on the molecular chain of the modified polyphenylene sulfide to the amount n of the total structural unit on the molecular chain. In another preferable embodiment, on the molecular chain of the modified polyphenylene sulfide, the ratio of the number of structural unit of

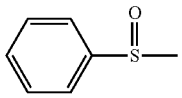

is about 25% or more, preferably 30% or more, for example, about 35%, 50%, 60%, such as about 35-40%. In yet another embodiment, on the molecular chain of the modified polyphenylene sulfide, the ratio of the number of structural unit of

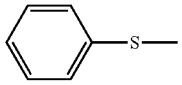

is about 20% or less, preferably about 10% or less.

In a preferable embodiment, based on the total amount of sulfur element on the molecular chain of the modified polyphenylene sulfide, the sulphonyl number is about 30% or more, preferably about 40% or more, such as about 45%, 50%, 60%, 80%, 100%, e.g., about 40-80%, 45-50%. In another preferable embodiment, based on the ratio of sulfur element on the molecular chain of the modified polyphenylene sulfide, the sulfinyl number is about 25% or more, preferably about 30% or more, for example, about 35%, 50%, 60%, e.g., about 35-40%. In yet another preferable embodiment, based on the ratio of sulfur element on the molecular chain of the modified polyphenylene sulfide, the number of unoxidized sulfur atoms is about 20% or less, preferably about 10% or less.

In one embodiment, the oxygen atom content on the molecular chain of the modified polyphenylene sulfide is about 10-30% by weight, preferably about 12-27% by weight, for example, about 15, 18, 20, 23, 25% by weight. In another embodiment, the sulfur atom content on the molecular chain of the modified polyphenylene sulfide is about 10-30% by weight, preferably about 15-25% by weight, for example, about 18, 20, 23% by weight.

In a further specific embodiment, the modified polyphenylene sulfide fiber is Dailun purchased from Shandong Feibao Material Technology Co., Ltd.

Considering the tear strength and tensile strength of the yarn or fabric containing the modified polyphenylene sulfide fiber, the denier of the modified polyphenylene sulfide fiber may be about 1-5 d (denier), preferably about 1.5-3.8 d, for example, about 1.5-2 d.

A proper content of modified polyphenylene sulfide fiber is beneficial for obtaining a yarn with good colour uptake (also called dyeability) and fire resistance. In one embodiment, based on the total weight of the yarn, the yarn contains about 4-20% by weight, preferably about 5-15% by weight of the modified polyphenylene sulfide fiber, for example, about 5, 10, 12, 15, 16, 17, 18, 19% by weight.

Modified Acrylic Fiber

The modified acrylic fiber according to the present discloses includes an antimony-containing compound. The antimony-containing compound includes but not limited to antimony trioxide, antimony tetraoxide, antimony pentaoxide, antimonic acid or a salt thereof, antimony oxychloride. In an embodiment, the antimony-containing compound is selected from the group consisting of antimony trioxide, antimony tetraoxide, antimony pentaoxide and a combination thereof.

In an embodiment, the modified acrylic fiber according to the present disclosure is acrylonitrile or a copolymer with other compound(s). In an embodiment, the modified acrylic fiber contains about 35-85% by weight of acrylonitrile and about 15-65% by weight of other ingredients. In another embodiment, the modified acrylic fiber contains about 35-65% by weight of acrylonitrile. In a specific embodiment, said other ingredients include but not limited to halogen-containing compounds.

In an embodiment, the modified acrylic fiber is Protex purchased from of Kaneka, Japan or a fire resistant vinylchloride-acrylonitrile copolymer fiber from Fushun Ruihua Fiber Co., Ltd, China Considering the tear strength and tensile strength of the yarn or fabric containing the modified acrylic fiber, the denier of the modified acrylic fiber is generally about 0.5-20d, preferably about 1-10d, for example, about 1.7d.

The content range of the modified acrylic fiber is beneficial for obtaining a product with good heat resistance and fire resistance. In an embodiment, based on the total weight of the yarn, the yarn contains about 35-90% by weight of modified acrylic fiber, preferably about 40-70% by weight, for example, about 40, 45, 50, 55, 60, 65% by weight.

Cellulosic Fiber

The cellulosic fiber herein is man-made cellulosic fiber, natural cellulosic fiber or a combination thereof. The natural cellulosic fiber is a cellulosic fiber derivative from a natural source. The man-made cellulosic fiber is a cellulosic fiber made from natural materials as raw materials. Specifically, the cellulosic fiber derived from a natural source includes but not limited to, cotton, flax, ramie, etc. The man-made cellulosic fiber made from natural materials as raw materials includes but not limited to acetate fiber, rayon, fire resistant rayon, Lyocell cellulosic fiber, wood fiber, tencel, etc. Preferable cellulosic fiber includes but not limited to cotton, flax, ramie, acetate fiber, rayon, fire resistant rayon, Lyocell cellulosic fiber. One cellulosic fiber can be used, or two or more cellulosic fiber can be used.

The cellulosic fiber is beneficial for rendering the obtained fabric product to have good absorbent, softness, tactile sensation, comfort. In an embodiment, based on the total weight of the yarn, the yarn contains about 10-55% by weight, preferably about 15-50% by weight, more preferably about 25-45% by weight of the cellulosic fiber, for example, about 30, 35, 40, 45% by weight.

Other Fibers

The yarn according to the present disclosure can optionally comprise other fibers than the modified polyphenylene sulfide fiber, the modified acrylic fiber, the cellulosic fiber. Said other fibers include but not limited to aliphatic polyamide based fiber, aramid fiber, acrylic fiber, polyester fiber, such as polytrimethylene terephthalate fiber and polybutylene terephthalate fiber, polyethylene terephthalate fiber, polyarylate fiber, polyolefine based fiber such as polyethylene fiber, polysulfonamide, polyimide, polyvinyl alcohol fiber such as vinylon fiber, polyvinyl chloride based fiber such as polyvinyl chloride fiber, polyurethane fiber, polyformaldehyde fiber, polytetrafluoroethylene fiber, melamine fiber, polysulfonamide fiber, antistatic fiber such as carbon fiber, metal fiber etc., preferably selected from the group consisting of aramid, polyarylate, polysulfonamide, polyimide, polyvinyl alcohol fiber, antistatic fiber, polyamide and a combination thereof.

The content range of other fibers should not affect the excellent effects of the yarn according to the present disclosure, such as good colour uptake and fire resistance. In an embodiment, based on the total weight of the yarn, the yarn comprises about 10% by weight or less of the other fibers. In another embodiment, based on the total weight of the yarn, the yarn comprises about 1.5% by weight or less of the antistatic fiber.

In an embodiment, based on the total weight of the yarn, the yarn according to the present disclosure comprises,

- about 4-20% by weight, preferably about 5-15% by weight of the modified polyphenylene sulfide fiber,
- about 35-90% by weight, preferably about 40-70% by weight of the modified acrylic fiber,
- optionally about 10-55% by weight, preferably about 15-50% by weight of the cellulosic fiber, and
- optionally about 10% by weight or less of other fibers.

It will be understood that the contents of the components can be reasonably selected such that the total amount of the components is 100%.

The yarn can be manufactured by process known in the art, including but not limited to ring spinning, vortex spinning, siro spinning, compact spinning, and other open-end spinning processes.

Fabric

Provided is also a fire resistant fabric, wherein the fabric comprises, based on the total weight of the fabric, about 4-20% by weight of modified polyphenylene sulfide fiber, and about 35-90% by weight of modified acrylic fiber.

The modified polyphenylene sulfide fiber comprised in the fabric according to the present disclosure is as defined above. A proper content of modified polyphenylene sulfide fiber is beneficial for obtaining a fabric with good colour uptake and fire resistance. In an embodiment, based on the total weight of the fabric, the fabric comprises about 4-20% by weight, preferably about 5-15% by weight of the modified polyphenylene sulfide fiber, for example, about 5, 10, 15% by weight.

The modified acrylic fiber comprised in the fabric according to the present disclosure is as defined above. The content range of modified acrylic fiber is beneficial for obtaining a product with good heat resistance and fire resistance. In an embodiment, based on the total weight of the fabric, the fabric contains about 35-90% by weight, preferably about 40-70% by weight of the modified acrylic fiber, for example, about 45, 50, 55, 60% by weight.

In an embodiment, the fabric according to the present disclosure further comprises a cellulosic fiber. The definition of the cellulosic fiber is as described above. The cellulosic fiber is beneficial for rendering the obtained fabric product to have good absorbent, softness, tactile sensation, comfort. In an embodiment, based on the total weight of the fabric, the fabric comprises about 10-55% by weight, preferably about 15-50% by weight of the cellulosic fiber, for example, about 40, 45% by weight.

In another embodiment, the fabric according to the present disclosure can further comprise other fibers than the modified polyphenylene sulfide fiber, the modified acrylic fiber, the cellulosic fiber. The types of said other fibers are as described above. The content range of other fibers should not affect the excellent effects of the fabric according to the present disclosure, such as good colour uptake and fire resistance. In an embodiment, based on the total weight of the fabric, the fabric comprises about 10% by weight or less of said other fibers. In another embodiment, based on the total weight of the fabric, the fabric comprises about 1.5% by weight or less of the antistatic fiber. The antistatic fiber is carbon fiber or metal fiber.

In an embodiment, based on the total weight of the fabric, the fabric according to the present disclosure comprises about 4-20% by weight, preferably about 5-15% by weight of modified polyphenylene sulfide fiber;

about 35-90% by weight, preferably about 40-70% by weight of modified acrylic fiber;

about 10-55% by weight, preferably about 15-50% by weight of optional cellulosic fiber; and about 10% by weight or less of optional other fibers.

It will be understood that the contents of the components can be reasonably selected such that the total amount of the components is 100%.

The fabric can be manufactured with the processes known in the art. The shape of the fabric includes but not limited to spinnable fabric, knitted fabric. Fabric weave includes but not limited to plain, twill, satin and a varied weave thereof, and can also be processed through filming combine machining.

In an embodiment, provided is a fabric comprising the fire resistant yarn according to the present disclosure.

The yarn and fabric according to the present disclosure have excellent fire resistance. They are tested under ASTM F2894, a criteria related to fabric thermal shrinkage test. After being kept at 260° C. for 5 min, the shrinkage rate is no more than about 15%. Using fire resistance test based on ASTM D6413, the tested carbonized length is 4 inches or less and the flame duration continues for 0 sec.

The yarn and fabric according to the present disclosure have excellent colour uptake. It can be evaluated by the performance of hue after dyeing, such as dark hue. Alternatively, it can be evaluated by sensory evaluation or a measurement based on Hunter Lab chrominance system chrominance.

In an aspect, provided is also a garment, comprising the fire resistant fabric according to the present disclosure.

In another aspect, provided is also a fire resistant workwear, comprising the fire resistant fabric according to the present disclosure.

The garment and workwear according to the present disclosure can utilize a single layer fabric according to the present disclosure, or two or more layers of the fabric according to the present disclosure.

Technical Effect

The yarn and fabric according to the present disclosure have good thermal stability, high temperature resistance and fire resistance. According to ASTM F2894 criteria, tested at 260° C. for 5 min, the thermal shrinkage rate of the fabric is within 15%. When the yarn and fabric are tested under the vertical burning test method according to ASTM D6413, neither the carbonized length before or after 100 times of water washing is more than 4 inches, that is, they can maintain good fire resistance even after 100 times of water washing. In addition, when the yarn and fabric according to the present disclosure are tested with the vertical burning test method ASTM D6413, the fabric according to the present disclosure obtains a carbonized length of no more than 4 inches, that is, the yarn and fabric according to the present disclosure comply with the NFPA 2112 technical criteria.

The yarn and fabric according to the present disclosure, by incorporation of the modified polyphenylene sulfide, have a great low-cost advantage compared to the technical solution of mixing polyarylate, aramid or polyimide with vinylchloride-acrylonitrile copolymer fiber/modacrylic as the main component.

The yarn and fabric according to the present disclosure have good absorbent, which greatly increases wearing comfort.

The yarn and fabric according to the present disclosure have excellent dyeability or easy colour uptake. There is nearly no parti colour on the surface of the fabric, solving the problem of heterochromia like occurrence of light yellow, pale yellow, pale red brown fluff due to the inability for dyeing, and the appearance of the fabric is greatly improved compared to the mixed dyeing of vinylchloride-acrylonitrile copolymer fiber or modified polyacrylonitrile, aramid, polyarylate, polyimide etc., especially when dark-colored products are required.

The yarn, fabric, garment, and fire resistant workwear according to the present disclosure can be widely used in the occupational protection of personnel in the fields of fire, electric power and other fields that require heat resistance and arc protection with flames.

EXAMPLES

The fire resistant yarn, fabric according to the present disclosure will be described in details below by reference to examples.

Materials

Modified acrylic fiber is fire resistant vinylchloride-acrylonitrile copolymer fiber purchased from Fushun Ruihua Fiber Co., Ltd.

Conventional polyphenylene sulfide fiber is purchased from Zhejiang Yuchen New Material Technology Co., Ltd.

Modified polyphenylene sulfide fiber is purchased from Shandong Feibao Material Technology Co., Ltd., with the trade name of Dailun and the denier is 1.5d-2d. The ratio of the number of structural unit of

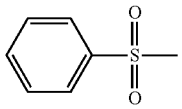

on the molecular chain is 45-50% and the ratio of the number of structural unit of

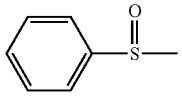

on the molecular chain is 35-40%.

Lyocell cellulosic fiber is purchased from Lenzing Company, Austria with the trade name of Lyocell.

Test

Fire resistance: ASTM D6413 criteria, for testing carbonized length (length of the carbonized part).

Absorbent: AATCC TS017.

Dyeability/Colour Uptake:

Navy blue dye was used to dye the fabric, where the amount of dye was 4-5% by weight of the fabric.

Sensory evaluation was carried out in 3 levels.

A: Dark colour (navy blue) hue can be fully expressed, and no white fiber (that is, fiber that cannot be dyed) was exposed on the fabric;

B: Although the hue was shown, an amount of white fibers were exposed on the fabric;

C: No hue was shown, more white fibers were exposed on the fabric;

D: No hue was shown, a lot of white fibers were exposed on the fabric.

Test and Result

The yarns were prepared using the formulation in Table 1, the fabrics were prepared based on the yarns. The performance of the corresponding Example 1-3 and Comparative Example 1-6 products were shown in Table 1.

TABLE 1

| 200 g/m$^2$ | Modified acrylic fiber | Modified polyphenylene sulfide fiber | Cellulosic fiber | Polyarylate | Paraaramid | Fire resistance ASTM D6413 carbonized length (inch) | Fire resistance ASTM D6413 flame duration (sec) | Thermal stability ASTM F2894 shrinkage rate (%) | Appearance heterochromia of the fabric in the case of dark dyeing | Absorbent (mm/s) |
|---|---|---|---|---|---|---|---|---|---|---|
| Example 1 | 45 | 15 | 40 | | | 3.2 | 0 | 7.5 | A | 0.3 |
| Example 2 | 50 | 10 | 40 | | | 3.7 | 0 | 8.5 | A | 0.3 |
| Example 3 | 50 | 5 | 45 | | | 4 | 0 | 12 | A | 0.33 |
| Comparative Example 1 | 50 | | 40 | 10 | | 3.7 | 0 | 6.6 | C | |
| Comparative Example 2 | 50 | | 40 | | 10 | 4.5 | 0 | 7.1 | C | |
| Comparative Example 3 | 50 | | 45 | | 5 | 4.9 | 0 | 8.8 | C | |
| Comparative Example 4 | 40 | 30 | 30 | | | 2.5 | 0 | 6 | C | 0.18 |
| Comparative Example 5 | | 100 | | | | | | | D | |

| 200 g/m$^2$ | Modified acrylic fiber | Conventional polyphenylene sulfide fiber | Cellulosic fiber | Fire resistance ASTM D6413 carbonized length (inch) | Fire resistance ASTM D6413 flame duration (秒) | Thermal stability ASTM F2894 | Appearance heterochromia of the fabric in the case of dark dyeing |
|---|---|---|---|---|---|---|---|
| Comparative Example 6 | 45 | 15 | 40 | 4.8 | 0 | 15 | D |

The carbonized lengths of Example 1-3 were shown in Table 1. It can be seen from the results that the products of Example 1-3 had good fire resistance and absorbent. After the samples of Example 1-3 were dyed with dark colour (navy blue), the navy blue hue can be fully expressed, and no white fiber (that is, fiber that cannot be dyed) was exposed on the fabric, showing good easy colour uptake.

For the sample of Comparative Example 1, although fire resistance was good, the fabric failed to show hue under dark colour dyeing, showing poor colour uptake performance. For the samples of Comparative Example 2-3, the obtained product had lower fire resistance and colour uptake performance. For the sample of Comparative Example 4, due to high content of used modified polyphenylene sulfide, the sample failed to show hue during the dyeing process, and more white fibers were exposed on the fabric. The pure modified polyphenylene sulfide sample of Comparative Example 5 had poor colour uptake. In the sample of Comparative Example 6, unmodified polyphenylene sulfide was used, and the obtained sample failed to show hue during the dyeing process, and a large amount of white fibers were exposed to the fabric.

Although typical embodiments have been illustrated and described herein, the present disclosure is not limited to the details. As various possible modifications or substitutions will not deviate from the spirit of the present disclosure, those skilled in the art can use conventional experiments to conceive of variants and equivalents, and therefore all these variants and equivalents fall within the spirit and scope as defined by the claims.

The invention claimed is:

1. A fire resistant yarn, characterized in that, the yarn comprises based on the total weight of the yarn, 4-20% by weight of modified polyphenylene sulfide fiber, and 35-90% by weight of modified acrylic fiber, wherein the modified polyphenylene sulfide is of Formula I

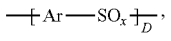

(Formula I)

x=0, 1 or 2, and

Ar—$SO_2$ is three of

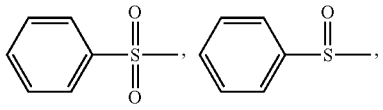

-continued

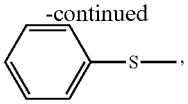

wherein the number n of structural unit in formula I is 10-70000, wherein the modified acrylic fiber comprises antimony-containing compound.

2. The yarn according to claim 1, characterized in that, the yarn further comprises based on the total weight of the yarn, 10-55% by weight of cellulosic fiber, wherein the cellulosic fiber is man-made cellulosic fiber, natural cellulosic fiber or a combination thereof.

3. The yarn according to claim 2, characterized in that, based on the total weight of the yarn, the content of the modified polyphenylene sulfide fiber is 5-15% by weight, and/or the content of the modified acrylic fiber is 40-70% by weight, and/or the content of the cellulosic fiber is 15-50% by weight.

4. The yarn according to claim 1, characterized in that, on the molecular chain of the modified polyphenylene sulfide, the ratio of the number of structural unit of

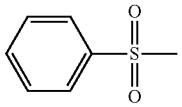

to the number n is 30% or more; and/or the ratio of the number of structural unit of

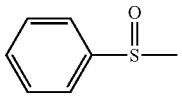

to the number n is 25% or more; and/or the ratio of the number of structural unit of

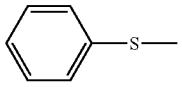

to the number n is 20% or less.

5. The yarn according to claim 1, characterized in that, the content of oxygen atom on the molecular chain of the modified polyphenylene sulfide is 10-23% by weight; and/or the content of sulfur atom on the molecular chain of the modified polyphenylene sulfide is 23-30% by weight.

6. The yarn according to claim 1, characterized in that, the antimony-containing compound is selected from the group consisting of antimony trioxide, antimony tetraoxide, antimony pentaoxide and a combination thereof.

7. The yarn according to claim 1, characterized in that, based on the total weight of the yarn, the yarn further comprises 10% by weight or less of other fiber selected from the group consisting of aramid, polyarylate, polysulfonamide, polyimide, polyvinyl alcohol fiber, antistatic fiber, polyamide and a combination thereof.

8. The yarn according to claim 7, characterized in that, based on the total weight of the yarn, the content of the antistatic fiber is 1.5% by weight or less, and/or the antistatic fiber is carbon fiber or metal fiber.

9. A fire resistant fabric, characterized in that, the fire resistant fabric comprises the fire resistant yarn according to claim 1.

10. The yarn according to claim 1, characterized in that, on the molecular chain of the modified polyphenylene sulfide, the ratio of the number of structural unit of

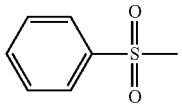

to the number n is 40% or more; and/or the ratio of the number of structural unit of

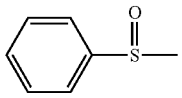

to the number n is 30% or more; and/or the ratio of the number of structural unit of

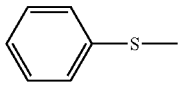

to the number n is 10% or less.

11. The yarn according to claim 1, characterized in that, the content of oxygen atom on the molecular chain of the modified polyphenylene sulfide is 12-20% by weight; and/or the content of sulfur atom on the molecular chain of the modified polyphenylene sulfide is 23-25% by weight.

12. A fire resistant fabric, characterized in that, the fabric comprises, based on the total weight of the fabric, 4-20% by weight of modified polyphenylene sulfide fiber, and 35-90% by weight of modified acrylic fiber, wherein the modified polyphenylene sulfide is of Formula I, (Formula I)

$$-[Ar-SO_x]_n-,$$

wherein, x=0, 1 or 2, and

Ar—$SO_x$ is three of

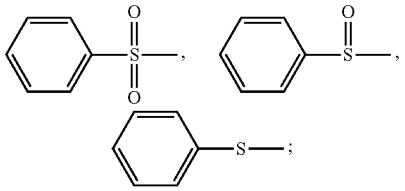

wherein the number n of structural unit in formula I is 10-70000, wherein the modified acrylic fiber comprises antimony-containing compound.

13. The fabric according to claim 12, characterized in that, the fabric further comprises, based on the total weight of the fabric, 10-55% of cellulosic fiber, wherein the cellulosic fiber is man-made cellulosic fiber, natural cellulosic fiber or a combination thereof.

14. The fabric according to claim 13, characterized in that, based on the total weight of the fabric, the content of the modified polyphenylene sulfide fiber is 5-15% by weight, and/or the content of the modified acrylic fiber is 40-70% by weight, and/or the content of the cellulosic fiber is 15-50% by weight.

15. The fabric according to claim 12, characterized in that, on the molecular chain of the modified polyphenylene sulfide, the ratio of the number of structural unit of

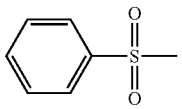

to the number n is 30% or more; and/or the ratio of the number of structural unit of

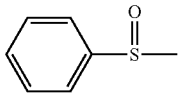

to the number n is 25% or more; and/or the ratio of the number of structural unit of

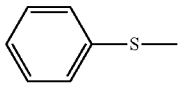

to the number n is 20% or less.

16. The fabric according to claim 12, characterized in that, the content of oxygen atom on the molecular chain of the modified polyphenylene sulfide is 10-23% by weight; and/or the content of sulfur atom on the molecular chain of the modified polyphenylene sulfide is 23-30% by weight.

17. The fabric according to claim 12, characterized in that, the antimony-containing compound is selected from the group consisting of antimony trioxide, antimony tetraoxide, antimony pentaoxide and a combination thereof.

18. The fabric according to claim 12, characterized in that, based on the total weight of the fabric, the fabric further comprises 10% by weight or less of other fiber selected from the group consisting of aramid, polyarylate, polysulfonamide, polyimide, polyvinyl alcohol fiber, antistatic fiber, polyamide and a combination thereof.

19. The fabric according to claim 12, characterized in that, based on the total weight of the fabric, the content of the antistatic fiber is 1.5% by weight or less, and/or the antistatic fiber is carbon fiber or metal fiber.

20. The fabric according to claim 12, characterized in that, the carbonized length measured by the fire resistance test of ASTM D6413 is 4 inches or less.

21. A garment, characterized in that, the garment comprises the fire resistant fabric according to claim 12.

22. A fire resistant workwear, characterized in that, the fire resistant workwear comprises the fire resistant fabric according to claim 12.

23. The fabric according to claim 12, characterized in that, on the molecular chain of the modified polyphenylene sulfide, the ratio of the number of structural unit of

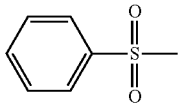

to the number n is 40% or more; and/or the ratio of the number of structural unit of

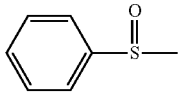

to the number n is 30% or more; and/or the ratio of the number of

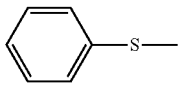

structural unit of to the number n is 10% or less.

24. The fabric according to claim 12, characterized in that, the content of oxygen atom on the molecular chain of the modified polyphenylene sulfide is 12-20% by weight; and/or the content of sulfur atom on the molecular chain of the modified polyphenylene sulfide is 23-25% by weight.

* * * * *